United States Patent [19]

Hotta et al.

[11] Patent Number: 4,692,560

[45] Date of Patent: Sep. 8, 1987

[54] FORCED FLOW COOLING-TYPE SUPERCONDUCTING COIL APPARATUS

[75] Inventors: Yoshiji Hotta, Hitachi; Kunishige Kuroda, Mito; Hiroshi Kimura, Tokyo; Nobuhiro Hara, Hitachi; Naofumi Tada, Hitachi, all of Japan

[73] Assignee: Hitachi, Ltd., Tokyo, Japan

[21] Appl. No.: 886,045

[22] Filed: Jul. 16, 1986

[30] Foreign Application Priority Data

Jul. 19, 1985 [JP] Japan ..... 60-158384

[51] Int. Cl.[4] ..... H01B 7/34

[52] U.S. Cl. ..... 174/15 CA; 335/300; 336/62; 62/514 R

[58] Field of Search ..... 355/216, 300; 174/15 CA, 15 S, 126 S, 128 S; 336/62, DIG. 1; 62/514 R

[56] References Cited

U.S. PATENT DOCUMENTS

| | | | |
|---|---|---|---|
| 4,369,636 | 1/1983 | Purcell et al. | 174/15 CA |
| 4,394,634 | 7/1983 | Van Sant | 174/15 CA |
| 4,625,192 | 11/1986 | Kawaguchi | 174/150 A X |
| 4,625,193 | 11/1986 | Purcell | 174/15 CA |

*Primary Examiner*—George Harris

*Attorney, Agent, or Firm*—Antonelli, Terry & Wands

[57] ABSTRACT

In a forced flow cooling-type superconducting coil apparatus including a superconducting coil having superconducting wires inserted into a hollow conduit, current leads for supplying a current to said superconducting coil, and cooling means for cooling said superconducting wires by forcibly flowing the coolant through said hollow conduit, a part of the coolant flowing through said cooling means is branched to cool said current leads.

10 Claims, 6 Drawing Figures

FORCED FLOW COOLING-TYPE SUPERCONDUCTING COIL APPARATUS

BACKGROUND OF THE INVENTION

The present invention relates to a superconducting coil apparatus wound with a cable-in-conduit superconductor made of superconducting wires housed in a metal conduit and cooled by coolant circulated in the metal conduit.

Methods for cooling superconducting coils are roughly classified into a pool boiling method and a forced flow cooling method. In the pool boiling method, the coil is directly immersed in the coolant. In the forced flow cooling method, the cable-in-conduit superconductor is wound to form a coil, and the coolant is forcibly circulated through internal passages formed in the conduit.

In case of the pool boiling method in which the coil is immersed in the coolant, it is required to provide a cryostat for housing the superconducting coil and coolant, as disclosed in Japanese Patent Unexamined Publication No. 98991/83 (JP-A-58-98991) published on June 13, 1983, for example. Further, the electrical insulation of the superconducting coil is influenced by the insulation of the coolant which is in contact with the outer surface of the superconducting wire to cool the wire. Accordingly, it is difficult to provide an apparatus having a high breakdown voltage.

In case of the forced flow cooling method, the cable-in-conduit superconductor itself serves as the coolant flow path. Accordingly, the cryostat for storing the coolant therein is not required. As a casing for enclosing the superconducting coil, the coolant, only a vacuum vessel with thermal insulation is required. Further, the breakdown voltage can be easily raised by selecting the insulation material because insulation depends on the surface of the conduit. In addition, the cooling performance is enhanced because the coolant is always flowing along the periphery of the superconducting wire located inside the conduit. In recent years, therefore, the forced flow cooling method is considered to be optimum to a superconducting coil such as a poloidal field coil for nuclear fusion reactor having a large-sized, complicated shape and producing high voltage. Thus the forced flow cooling method attracts attention from various fields for development.

A superconducting coil apparatus using the forced flow cooling-method is disclosed in Japanese Patent Unexamined Publication No. 14409/85 (JP-A-60-14409) published on Jan. 25, 1985, for example. The apparatus thus disclosed has various protective devices which are not concerned with the present invention. FIGS. 4 to 6 show principally the prior art apparatus using the forced flow cooling method as disclosed, but modified to show in detail only parts relating to the present invention by omitting the above described protective devices. The prior art apparatus will now be outlined by referring to FIGS. 4 to 6. Therefore, the structure shown in FIGS. 4 to 6 appears to be different from that illustrated in Japanese Patent Unexamined Publication No. 14409/85. However, it is to be understood that both apparatuses are the same in basic structure excepting the above described protective devices.

FIG. 4 is a sectional view of a forced flow cooling-type superconductor. The conductor as shown in FIG. 4 is used also in the present invention apparatus. A superconductor 1 is composed of a square-shaped pipe (conduit) 2 made of stainless steel and a number of superconducting wires 4 disposed in a coolant path 3 inside the pipe 2 along the path. By letting flow helium through the coolant path 3, the superconducting wires 4 are so cooled as to assume the superconducting state.

FIGS. 5 and 6 show a forced flow cooling-type superconducting coil 10 using the above described superconductor 1 and a typical coolant generating unit 17 disposed for the coil. Principal components are a circulation compressor 5, a housing vessel 9 for housing a liquid nitrogen tank 6, a liquid helium tank 7 and a heat exchanger 8 of countercurrent type, a cryostat 11 evacuated for housing a superconducting coil 10, coolant transfer pipes 12*a* and 12*b* for coupling the cryostat 11 to the housing vessel, current leads 14*a* and 14*b* respectively connected to ends 1*a* and 1*b* of the superconductor 1, and an electric power source 15. Cooling is conducted by a method described hereinafter. That is to say, helium forming the coolant is compressed by the circulation compressor 5 and led into the vessel 9 housing the heat exchanger. The helium is cooled to approximately 80° K. in the liquid nitrogen tank 6 and exchanges heat with the return gas in the heat exchanger group 8. The helium is then cooled to approximately 5° K. in the liquid helium tank 7 to become supercritical pressure helium. The supercritical pressure helium is supplied to the cryostat 11 through the helium transfer pipe 12*a* and combined in a terminal box 13 with the current lead 14*a* coming from the power source 15 to cool the superconducting coil 10. The return gas reenters the vessel 9 housing the heat exchanger through the return helium transfer pipe 12*b*. The return gas then undergoes J-T expansion in a Joule-Thomson valve 16 to be liquefied. The liquid helium is stored in the liquid helium tank 7. The gas evaporated here and the gas which is not liquefied return to the circulation compressor 5 through the return pipe while exchanging heat with the incoming gas. The above described process is repeated to cool the superconducting coil.

Drawbacks caused when such an apparatus is used to cool the superconducting coil will now be described. As evident from FIG. 6, the prior art apparatus is not especially equipped with means for preventing the intrusion of the heat from the current leads 14*a* and 14*b*. Only the thermal conduction of the circulating coolant is used. Accordingly, cooling is insufficient for heat intrusion caused by the thermal conduction from the external normal temperature section and the heat generation attendant upon the flowing current. Thus it takes a long time to cool the coil and the temperature of the coolant is raised. As a result, the superconducting state of the coil cooled in the forced flow mode becomes unstable.

Problems of heat generation caused by the current flowing through the current leads and temperature rise of the superconductor caused by the heat intruding from the outside through the current leads are present also in a superconducting coil apparatus using the pool boiling method. In order to prevent such problems, in the aforementioned Japanese Patent Unexamined Publication No. 98991/83, for example, the current leads are inserted into a tube and cooled by passing through the tube a vaporized gas of the liquid helium in the cryostat. However, this method cannot be applied to a superconducting coil apparatus of forced flow cooling method in which no cryostat is used.

SUMMARY OF THE INVENTION

An object of the present invention is to provide a forced flow cooling-type superconducting coil apparatus which is free from the above described drawbacks of the prior art, which is capable of reducing the influence of the heat intruding from the current lead and the influence of heat generation derived from a current flowing therethrough and which is capable of realizing a sufficiently stable superconducting state.

As described before, the heat generation due to the resistance heat becomes nearly zero when the superconducting coil is in the superconducting state. And the heat source causing the temperature rise is considered to be nearly the heat transmitted from the external normal temperature environment through the current leads and the resistance heat generated in the current leads themselves under normal state. If these kinds of transferred heat exceed the cooling capacity of the coolant forcibly circulated, the temperature of the superconducting coil rises above the critical temperature of the superconductor used in the coil. Since the superconducting coil cannot maintain the superconducting state, the resistance heat of the superconducting coil itself abruptly increases. And its temperature acceleratedly rises. To prevent this, it is conceivable to increase the cooling capacity so that the temperature of the superconducting coil may not rise above the critical temperature even if the above described transferred heat is increased. In this case, however, the cooling apparatus becomes very large in size and the advantage of the forced flow cooling method is lost.

In a forced flow cooling-type superconducting coil apparatus according to the present invention, the above described object is attained by emitting the above described transferred heat before it reaches the superconducting coil to decrease the influence of the transferred heat upon the superconducting coil. A part of the circulating coolant for forcibly cooling the superconductive coil is branched, and means for cooling the current leads which act as the transmission path of the above described transfer heat is provided.

DESCRIPTION OF THE PREFERRED EMBODIMENTS

Figure 1:
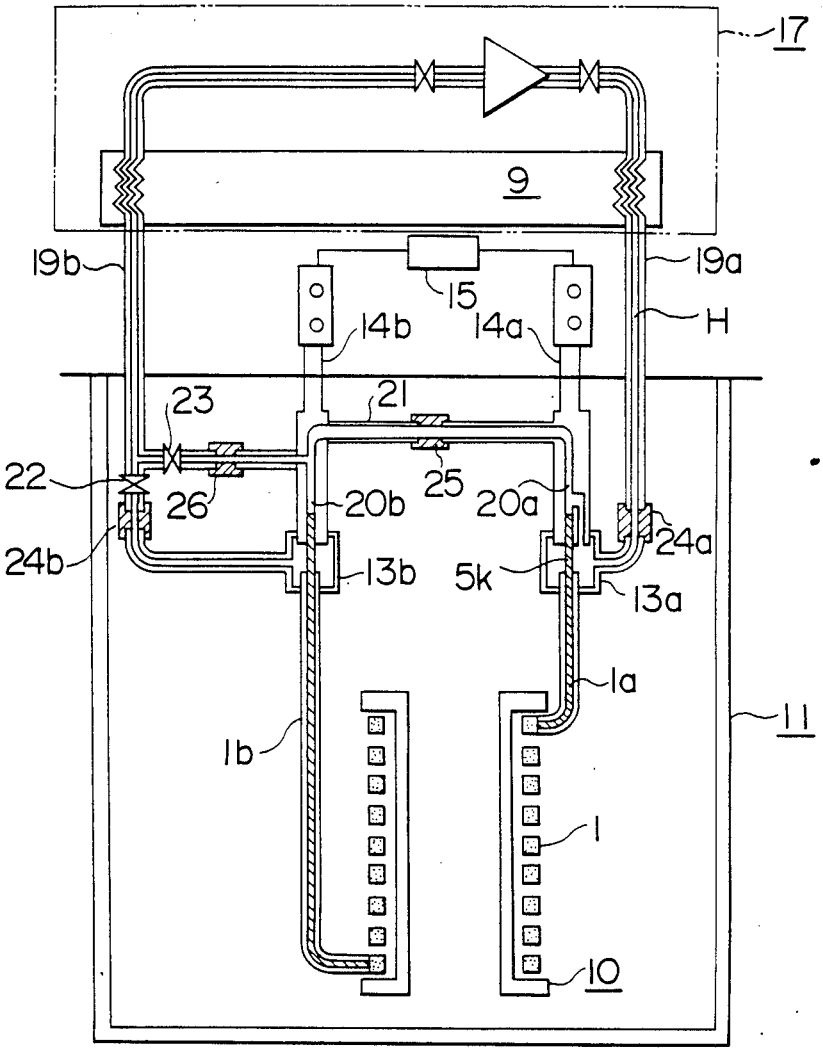
FIG. 1 shows the configuration of an embodiment of a forced flow cooling-type superconducting coil apparatus according to the present invention.
Figure 5:
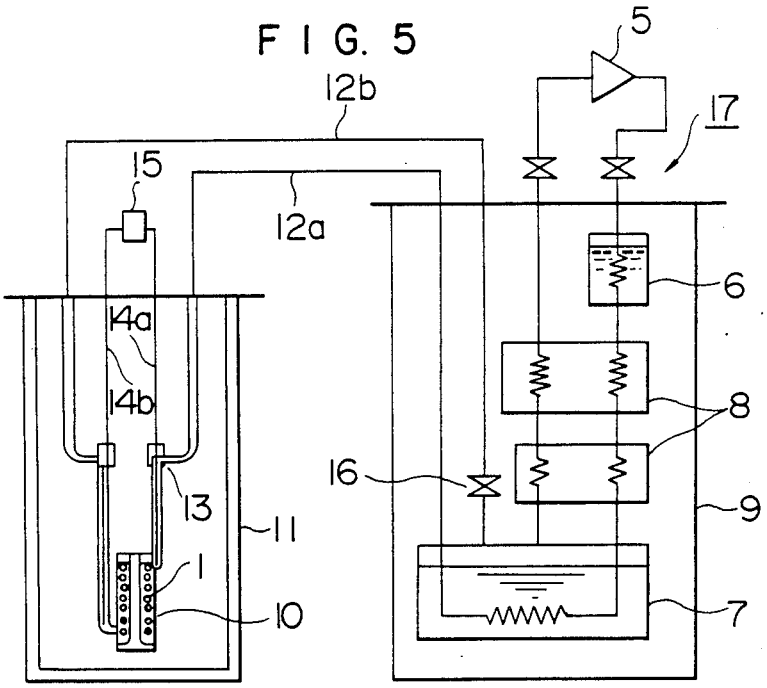
FIG. 5 shows a conventional example of cooling system for a forced flow cooling-type superconducting coil apparatus.
Figure 6:
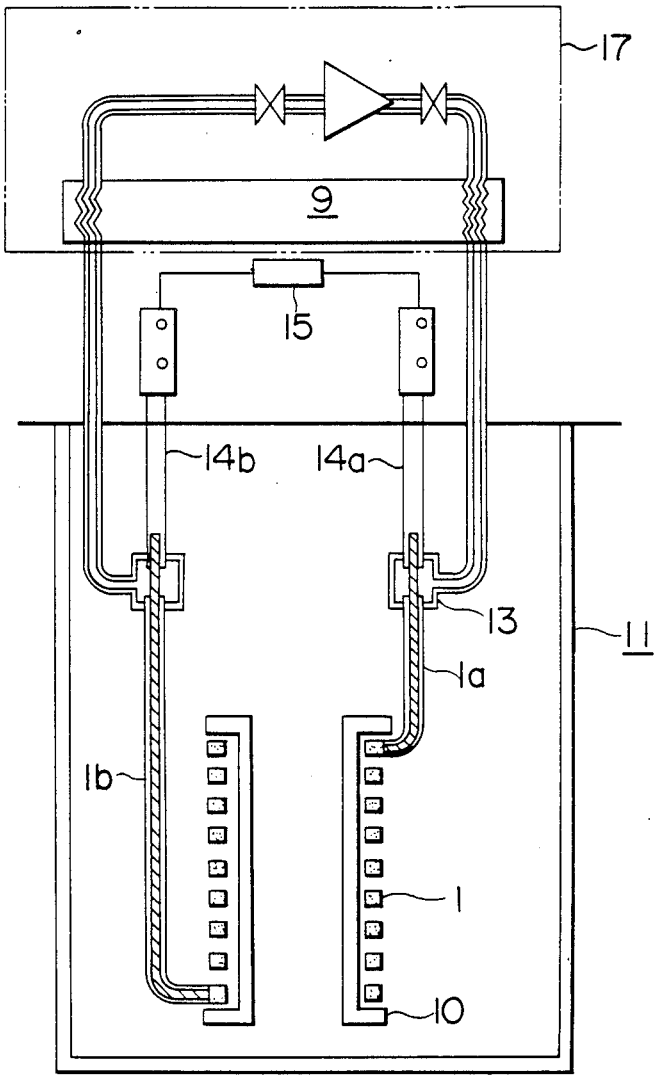
FIG. 6 shows the configuration of a conventional forced flow cooling-type superconducting coil apparatus.

FIG. 1 shows an embodiment of the present invention. A tube 19*a* for supplying supercritical helium He as the coolant, a return tube 19*b* of the helium, coolant paths 20*a* and 20*b* disposed inside hollow current leads 14*a* and 14*b*, a bypass tube 21, flow rate adjusting valves 22 and 23, and insulation sections 24*a*, 24*b*, 25 and 26 are shown in FIG. 1. And terminal boxes 13*a* and 13*b* are disposed at coupling points where leads 14*a* and 14*b* are respectively coupled to ends 1*a* and 1*b* of the superconductor. Other components are the same as those of the prior art described by referring to FIGS. 5 and 6.

The coolant path 20*a* is formed by hollowing out of the current lead 14*a* along its longitudinal direction. Ends of the coolant path 20*a* are opened so that one end may be inserted into the terminal box 13*a* and the other end may be coupled to the bypass tube 21.

On the other hand, the coolant path 20*b* is formed in the current lead 24*b*. Ends of the coolant path are opened so that one end may be coupled to the bypass tube 21 and the other end may be coupled to the flow rate adjusting valve 23.

It is preferable to make the length of the hollow path 20*a* as long as possible with respect to the length of the current lead 14*a*. The length ratio is at least 50% and usually around 80%.

The operation of this embodiment will now be described.

The supercritical helium He supplied from the coolant generating apparatus 17 enters the terminal box 13*a* through the tube 19*a* and is branched to cool the superconductive coil 10 of forced flow cooling-type and cool the current leads 14*a* and 14*b*. The coolant for cooling the coil enters the superconductor 1 from the terminal box 13*a* to cool the superconductive coil 10. Thereafter, the coolant enters the return tube 19*b* from the terminal box 13*b* located at the exit side and returns to the coolant generating apparatus 17.

On the other hand, the coolant for cooling the current leads enters the coolant path 20*a* from the opening located under the current lead 14*a* and cools the current lead 14*a*. The coolant then passes through the bypass tube 21 disposed between current leads 14*a* and 14*b* and returns to the return tube 19*b*, where the coolant is combined with the coolant which has cooled the superconducting coil 10. The combined coolant returns to the coolant generating apparatus 17. And its flow rate is adjusted by manipulating the adjusting valve 23.

Figure 2:
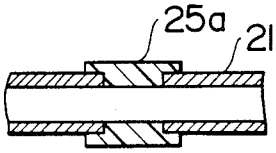
FIG. 2 shows the structure of an insulation section of a coolant pipe.

The current supply to the superconducting coil 10 is effected by connecting the power supply 15 to the superconductor 1 in the terminal boxes 13*a* and 13*b* through the current leads 14*a* and 14*b*. At necessary positions of the tubes, insulation sections 24*a*, 24*b*, 25 and 26 are so disposed that the coolant tubes may not form current paths short-circuiting the above described current leads. The structure of the insulation section is shown in FIG. 2. A ring-shaped part of the coolant tube made of stainless steel, for example, is removed and replaced by an insulation material 25*a* made of ceramics or resins.

Figure 4:
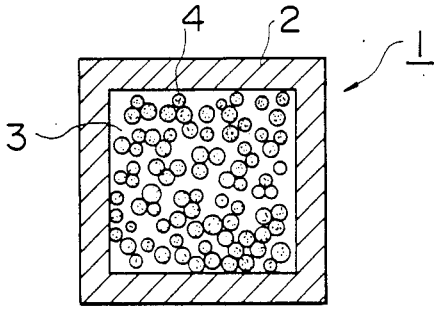
FIG. 4 shows a sectional view of a superconducting conductor used in a circulation cooling-type superconductive coil apparatus.

The experiment for confirming the effect of this embodiment will now be described. The square-shaped conduit 2 as shown in FIG. 4 was made of stainless steel having thickness of 1.4 mm so as to provide an inside hollow of 7 mm×7 mm. And 27 superconducting wires of 1.07 mmϕ were inserted into the conduit 2 with Void fraction of 50%. The resultant superconductor 1 having the length of 34 m was wound around a bobbin having internal diameter of 100 mm to make the superconducting coil 10 adapted to be used in the forced flow cooling mode. The superconducting coil 10 was cooled by using supercritical helium having pressure of 5 atm and having mass flow rate of 3 g/s and supplied with a current up to 200 A from a stabilized DC power source.

In order to observe the cooling effect of the current leads, the temperature was measured by using a thermosensor attached within the terminal box under the condition that the flow rate adjusting valve 23 was kept closed. The temperature was also measured under the condition that the opening of the adjusting valve 23 had been adjusted.

As a result, the coolant temperature rose when the adjusting valve 23 was not opened, i.e., under the same state of the adjusting valve 23 as that of the prior art method. Even if the mass flow rate of the coolant flowing through the coil was increased to 5 g/s, the superconducting coil 10 was already transferred to the normal state at the flowing current of 120 A. Under the condition that the flow rate adjusting valve 23 was opened and the coolant of 1 g/s in mass flow rate was supplied to the current leads 14*a* and 14*b*, the coil 10 was not transferred to the normal state even if the coolant quantity was kept at 3 g/s and the flowing current was increased to 200 A. It was thus possible to continue stable operation, and the temperature rise was negligible. As a result, a sufficient effect was confirmed.

Figure 3:
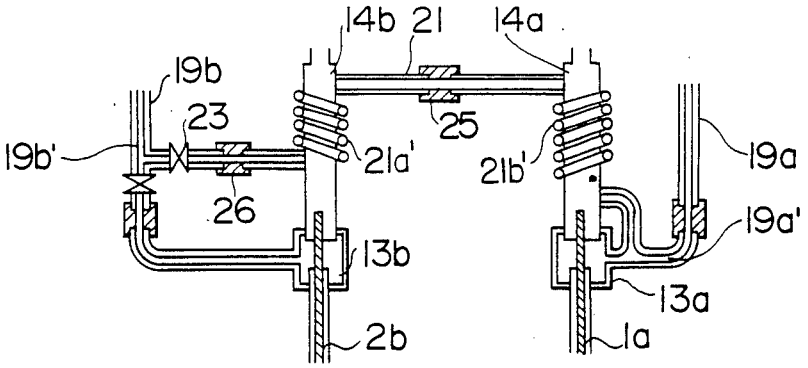
FIG. 3 shows the configuration of a principal part of another embodiment of the present invention.

Another embodiment of the present invention will now be described by referring to FIG. 3. FIG. 3 shows only a principal part, and the part which is not illustrated is the same as FIG. 1. In this embodiment, a branch 19*a*′ is disposed near the terminal box 13*a* of coolant tube 19*a*, and one end of the bypass cooling tube 21 is connected to the branch 19*a*′. The bypass cooling tube 21 has a part 21*a*′ wound around the current lead 14*a* and another part 21*b*′ wound around the current lead 14*b*. The other end of the bypass cooling tube 21 is connected to a branch 19*b*′ of the coolant tube 19 through the valve 23. The current leads 14*a* and 14*b* are cooled by the coolant flowing through the wound parts 21*a*′ and 21*b*′ of the cooling tube. In this way, an effect similar to that of FIG. 1 is obtained.

According to the present invention as described above, the current leads for the superconducting coil used with forced flow cooling method are sufficiently cooled. It is thus possible to easily provide a forced flow cooling-type superconducting coil apparatus which is free from drawbacks of the prior art, which exhibits efficiently suppressed temperature rise against the heat intruding from the current leads and the heat generated by the flowing current, and which is able to run under stable state.

The present invention has been described by referring to embodiments. However, it is apparent to those skilled in the art that the present invention is not limited to those embodiments and various modifications are possible without departing from the scope of the present invention.

We claim:

1. A forced flow cooling-type superconducting coil apparatus comprising:

a superconducting coil made of a coiled superconducting conductor having a hollow conduit and having superconducting wires inserted into said conduit;

current leads for supplying currents to superconducting wires of said superconducting coil, said current leads being respectively connected to ends of said superconducting coil;

first cooling means for forcibly flowing coolant for cooling said superconducting wires from one end of said hollow conduit of said superconducting coil to the other end thereof through said hollow conduit; and second cooling means including branch means for branching a part of said coolant to flow from a position near said one end of said hollow conduit of said first cooling means to another position near said another end of said hollow conduit along at least a part of each of said current leads thereby cooling said current leads by said branched coolant.

2. A forced flow cooling-type superconducting coil apparatus according to claim 1, wherein said second cooling means includes hollow sections formed in portions of said current leads where said current leads are respectively coupled to ends of said superconducting coil, and wherein said coolant branched from said first cooling means is let flow through said hollow sections.

3. A forced flow cooling-type superconducting coil apparatus according to claim 2, wherein said second cooling means includes a valve for adjusting the flow rate of said coolant flowing through said second cooling means.

4. A forced flow cooling-type superconducting coil apparatus according to claim 3, wherein said second cooling means includes insulation means for preventing a current path short-circuiting said current leads from being formed.

5. A circulation cooling-type superconducting coil apparatus according to claim 1, wherein said second cooling means includes hollow pipe sections respectively wound around said current leads, and said second cooling means includes means for letting flow said coolant branched from said first cooling means through said hollow pipe sections.

6. A forced flow cooling-type superconducting coil apparatus according to claim 5, wherein said second cooling means includes a valve for adjusting the flow rate of said coolant flowing through said second cooling means.

7. A forced flow cooling-type superconducting coil apparatus according to claim 6, wherein said second cooling means includes insulation means for preventing a current path short-circuiting said current leads from being formed.

8. A forced flow cooling-type superconducting coil apparatus comprising:

a superconducting coil having a hollow conduit and having superconducting wires inserted into said conduit;

current leads for supplying currents to superconducting wires of said superconducting coil, said current leads being respectively connected to ends of said superconducting coil;

two terminal boxes disposed at respective coupling points between ends of said superconducting coil and said current leads;

first cooling means for letting flow coolant for cooling said superconducting wires from one of said terminal boxes to the other of said terminal boxes through said hollow conduit; and second cooling means for branching a part of coolant flowing through said first cooling means at said one terminal box to flow along at least a part of each of said current leads thereby cooling said current leads.

9. A forced flow cooling-type superconducting coil apparatus according to claim 8, wherein said second cooling means includes hollow sections of said current leads where said current leads are respectively connected to ends of said superconducting coil, and wherein the hollow section of one of said current leads connected to said one terminal box is in flow communication with said one terminal box, whereby said coolant branched from said first cooling means flows through the hollow section of the other current lead into the hollow section of said one current lead.

10. A forced flow cooling-type superconducting coil apparatus according to claim 8, wherein said second cooling means includes hollow pipe sections respectively wound around said current leads, and said second cooling means includes means for making said hollow pipe section wound around said one current lead connected to said one terminal box in flow communication with said one terminal box, whereby said coolant branched from said first cooling means flows through said one terminal box into said hollow pipe sections wound around said current leads.

* * * * *